US005326377A

United States Patent [19]

Tuohimaa et al.

[11] Patent Number: 5,326,377

[45] Date of Patent: Jul. 5, 1994

[54] METHOD OF TREATING HIDES

[75] Inventors: Timo Tuohimaa, Helsinki; Aila Ukkonen, Espoo, both of Finland

[73] Assignee: AGA Aktiebolag, Sweden

[21] Appl. No.: 839,773

[22] PCT Filed: Oct. 11, 1990

[86] PCT No.: PCT/SE90/00652

§ 371 Date: Apr. 30, 1992

§ 102(e) Date: Apr. 30, 1992

[87] PCT Pub. No.: WO91/05877

PCT Pub. Date: May 2, 1991

[30] Foreign Application Priority Data

Oct. 13, 1989 [SE] Sweden ..... 8903378-1

[51] Int. Cl.[5] ..... C14C 1/08; C14C 3/04

[52] U.S. Cl. ..... 8/94.18; 8/94.15; 8/94.25; 8/94.26; 8/94.27; 8/94.28; 8/94.29; 8/94.33

[58] Field of Search ..... 8/94.15, 94.18, 94.27, 8/94.26, 94.33, 94.25, 94.28, 94.29

[56] References Cited

U.S. PATENT DOCUMENTS 875,382 12/1907 Rohm .
2,004,473 6/1935 Pensel ..... 8/94.27
4,614,520 9/1986 Ibello et al. ..... 8/94.15

FOREIGN PATENT DOCUMENTS 3827382 5/1989 Fed. Rep. of Germany .
WO88/10317 12/1988 PCT Int'l Appl. .
7744 of 1886 United Kingdom .
12681 of 1886 United Kingdom .

OTHER PUBLICATIONS

"The Use of Carbon Dioxide for Deliming", by Edwin E. Ochs, *JALCA*, vol. 48, pp. 105–110, (1953).

*Primary Examiner*—Prince Willis, Jr.
*Assistant Examiner*—Alan D. Diamond
*Attorney, Agent, or Firm*—Calfee, Halter & Griswold

[57] ABSTRACT

There is described a method for treating delimed and bated hides, i.e. pelts. According to the inventive method, the pelts are brought to a suitable mineral tanning state and then tanned with mineral salts. The inventive treatment process corresponds to the conventional processes of pickling, tanning and basifying. The inventive method includes the treatment of pelts with weakly acid treatment liquids while supplying carbon dioxide and additions of tanning mineral substances subsequent to pretreatment, without or with the addition of solely a small amount of liquid, wherein the quantity of treatment liquid is supplemented after a predetermined treatment time.

16 Claims, No Drawings

METHOD OF TREATING HIDES

The present invention relates to a method of pretreating and mineral-tanning hides which have been delimed and steeped in bate, i.e. have been bated. This method is intended to obviate the pickling and basifying steps (German: "Abstumpfen") which respectively precede and follow the conventional mineral tanning process.

Because of a greater awareness of present day environmental problems, the method is intended to reduce effluent emissions which contain contaminating mineral salts, acids and mineral tanning substances irreversibly bound to the hides.

By pickling is meant the treatment of organic products with salts, often in weak acid solutions. In the production of leather, the object of the pickling process is to bring the prepared hides and skins to a slightly acid state, suitable for mineral-tanning purposes.

The hide-substance can be brought to the desired degree of acidity, by treating the hide material with a strong acid in salt solution. Subsequent to being bated, the pelts, i.e. the hides stripped from hair, softened and delimed or decalcinated, will contain varying quantities of alkali.

Another object of the pickling process is to stabilize reaction of the pelts on the acid side, so as to create favorable conditions in the initial stages of the mineral-tanning process.

Hides or pelts to which acids are chemically bound have a lower affinity to tanning mineral salts than hides which are chemically neutral. Tanning is rendered more gentle by proceeding in the aforesaid manner and "drawing of the grain" and other leather defects are eliminated. The salt contained in the pickled pelts also has the same effect.

Strong mineral acid solutions result in pronounced swelling of the hides. This swelling can be reduced by adding a neutral salt, e.g. sodium chloride, which functions to dehydrate the functional hide-groups ionized by the acid.

It is necessary to adapt the amount of acid used in the pickling process to the nature of the pretreatment to which the hide or pelt has been subjected, and also to the type of leather to be produced and to the subsequent tanning process. Mineral acid, for instance sulfuric acid, is used in quantities which range from 0.5–2 percent, based on the weight of the pelt. The amount of salt required is normally about 10 percent calculated on the weight of the pelt. The salt-concentration should not be less than 5 percent, since a weaker salt solution than 5 percent is unable to prevent acid-swelling totally.

By basifying ("Abstumpfung") is meant increasing the acid pH-value, necessary in the initial stage of a mineral-tanning process, to a weaker acid range.

Furthermore, it is desired to convert to tanning-active carboxyl anions those carboxylic groups which are responsible for binding the mineral-tanning substances to the fibers of the hide. At the same time, the anions present in the mineral-tanning substance complex shall be exchanged for hydroxyl ions ("masking"), thereby resulting in a condensation reaction between the complex mineral-tanning substance bound to the fibers of the hide ("Verolung").

This condensation reaction results in cross-linking within the hide and therewith in stabilization of the hide fibre-network (tanning).

Basification is achieved either by adding more or less strongly basic reacting salts (e.g. $NaHCO_3$, HCOONa, MgO) or not-readily dissolved but acid-soluble salts (e.g. MgO, $MgCO_3$) already present in the mineral tanning substance.

An object of the present invention is to provide a method in which hides can be tanned with mineral tanning substances in the absence of pickling and basifying ("Abstumpfen") processes.

Another object of the invention is to reduce the quantities of salt, acid and non-bound mineral tanning substances contained in the waste water discharged from tanneries to the recipient.

Another object is to provide a method of treating hides with which tanning can be effected satisfactorily with smaller quantities of mineral tanning substances, by more efficient use of said substances.

These objects are achieved in accordance with the invention with a method of treating delimed and bated hides which replaces pickling and renders basification ("Abstumpfung") unnecessary in the subsequent mineral tanning process. The method is characterized by washing the bated hides once or a number of times with a slightly acid washing liquid which contains carbon dioxide, and subsequently treating the drained washing liquid with (powderous mineral tanning substance) in or without liquid, optionally while adding carbon dioxide and/or small quantities of acid. The amount of liquid present can be increased during the tanning process. Preferred embodiments of the invention are defined in the claims dependent on the independent claim.

Normally, deliming and subsequent bating of the hides is effected in horizontal rotating drums. Upon completion of the bating process, the treatment liquid is allowed to drain-off the pelts, i.e. the dehaired, softened, delimed and bated hides.

The pelts are then washed once or a few times at room temperature with 50–200 percent washing liquid, wherein 0.2 to 0.5 percent of an acid, preferably formic acid, diluted with water to a ratio of 1:10 is added in order to avoid the risk of the pelts swelling.

Because the alkali present in the hides quickly neutralizes the acid added to the system, and in order to bind residual quantities of calcium or magnesium compounds present in the hides or in the treatment liquid, either a carbon-dioxide generating substance or a gas which contains carbon dioxide, preferably pure carbon dioxide, is added to the rotating drum when commencing the washing process. The gas can be introduced directly into in the liquid and dissolved therein or delivered over the liquid surface (for instance through a hollow drum axis), said gas being dissolved in the liquid as a result of drum rotation.

The carbon dioxide is added in an amount of 0.5 to 5 percent by weight of the weight of the pelt. The washing time may vary from 15 to 60 minutes, although shorter or longer periods are not excluded at times. The washing process can be carried out once or a number of times, although the pH of the washing liquid shall lie between 4.0 and 6.0, normally between 4.3 and 5.3, and particularly between 4.6 and 4.8, upon completion of the wash.

The washing liquid is drained-off and the pelts therewith dewatered after each washing stage.

0 to 30 percent water, normally 10 percent, is charged to the drum containing the dewatered pelts; when the pH value of the latest washing liquid that has drained off is above 5, it is suitable to add 0.1 to 0.3 percent acid, normally 0.2 percent formic acid, to the treatment liquid. The treatment liquid may contain additions of water-soluble fats or water-emulsifiable fats (German: "Lickeröle") in a quantity of up to 4 percent of the weight of the pelts.

At the same time, tanning salts of low basicity are added to the treatment liquid in an amount of 0.5 to 2 percent, preferably 1 percent, said salts normally being alum compounds or commercially available sulphate-masked mineral tanning substances having a basicity of at most 33 percent. As the drum containing the pelts, the addition chemicals and possibly also the treatment liquid rotates, a gas containing carbon dioxide, for instance gaseous carbon dioxide, is charged to the drum. The carbon dioxide can be introduced, for instance, directly into the treatment liquid or over the surface thereof, said gas dissolving in the liquid as a result of drum rotation. The carbon dioxide is added in an amount corresponding to 0.5 to 5 percent by weight of the weight of the pelts. The treatment time is 0.5 to 3 hours, but may be longer or shorter in certain cases.

A sufficiently large quantity of treatment liquid is obtained even when using small quantities of treatment liquid, as a result of the liquid that is given up by the water-sodden delimed pelts.

When the drum containing the pelts and the treatment liquid has rotated for a time period of from 30 to 60 minutes, a commercially available sulphate-masked mineral-tanning substance having a basicity of 0 to 50 percent is introduced into the drum in an amount of 10 percent. When the amount of treatment liquid produced in the drum is very small, 10 to 30 percent treatment liquid can be added to the drum, together with the tanning substance, said additional treatment liquid optionally containing an acid in an amount of 0.1 to 0.5 percent by weight.

The drum is allowed to rotate while continuing the supply of carbon dioxide, until the tanning substance has completely penetrated the hides present in the drum. This normally takes from 1 to 4 hours.

The supply of carbon dioxide to the drum is interrupted, when the tanning substance has soaked through the hides ("durchgegerbt"). At the same time, the amount of treatment liquid present is increased, by adding water, in an amount of 20 to 100 percent, calculated on the weight of the hides corresponding to the conventional tanning method. The temperature of the treatment liquid can be increased from 30° to 40° C., by supplying energy to the system or through the heat generated by friction.

The tanning drum is then allowed to rotate for at least a further hour. It is preferred, however, to continue the method for a longer period of time, normally from 4 to 8 hours, preferably over night, so as to improve the take-up of tanning substances. The drum is preferably rotated discontinuously and, for instance, at most for 5 minutes in each hour.

Upon completion of the treatment process, the thus treated ("tanned") pelts can be further processed in a conventional manner.

EXAMPLE

Subsequent to bating hides, the bating liquid was emptied from the treatment drum and 100 percent water, calculated on the weight of the pelts, was added to the hides, or rather the pelts, present in the drum. The water contained 0.2% formic acid (HCOOH). The drum was then rotated for 30 minutes. At the same time, carbon dioxide was introduced through the hollow shaft of the drum at a flow rate of 5 liters per minutes.

At the end of this drum-rotation period, the washing liquid was allowed to drain-off and the washing stage described in the previous paragraph was repeated. The liquid was found to have a pH=about 4.8 upon termination of the 30-minute long rotation period in the second stage. This washing liquid was also allowed to drain-off.

To the hides remaining in the drum were added 10 percent water, 0.2 percent formic acid and 2 percent technical chromium alum [$KCr(SO_4)_2:xH_2O$] in powder form. The treatment drum was then rotated for 30 minutes, during which time carbon dioxide was introduced to the drum through the hollow shaft at a flow rate of 5 liters per minute.

3 percent of a commercially available sulphate-mask chromium tanning substance having a basicity of 33 percent was then introduced into the drum, in powder form. This chromium preparation is retailed, for instance, under the trade names CHROMOSAL B, CUTRICHROM, BASOCHROM. The treatment drum was then rotated for a further 60 minutes, while introducing gaseous carbon dioxide to the drum. The treatment liquid had a pH=3.9 upon completion of this treatment process. The tanning substance was found to have completely penetrated the pelts present in the tank in the drum.

50 percent water (calculated on the weight of the hides) having a temperature of 30° C. was then introduced into the drum and the supply of carbon dioxide was interrupted and the drum rotated for a further 60 minutes. The pelts were left in the drum over night, in order to improve the take-up of tanning substance, the treatment drum being rotated each hour over a total time of 60 minutes.

The wet blue produced in this way could then be further treated in a conventional manner to produce leather of a quality comparable with the quality of leather produced by conventional processes.

Upon completion of the inventive treatment process, the chromium content of the treatment liquid was found to be less than 0.5 g $Cr_2O_3$ per liter. The residual chromium in solution in the treatment liquid could be precipitated substantially quantitatively, by simple alkalization of the treatment liquid to a pH=8.5, without adding flocculation agents.

Leather analyses were carried out on crusts obtained with the present inventive method and these analyses were compared with the analyses of industrially produced crusts.

To this end, wet blues obtained in accordance with the present inventive method were transported to a tannery and there further treated together with wet blues produced conventionally in said tannery.

The tannery produces upper leather for shoes. Deliming was carried out in a conventional manner, with ammonium sulphate, and 5 percent BAYCHROM-tanning (BAYCHROM is a trade name of a commercially available tanning agent) substances were used in the tanning process. The analysis results are set forth in the following Table.

TABLE

| | Aga-crust | Convent. crust |
|---|---|---|
| Ash content in percent | 2.99–3.15 | 3.91–4.19 |
| $Cr_2O_3$-content in percent | 2.59–2.83 | 3.16–3.27 |
| pH-value | 3.96 | 3.95 |
| Thickness in mm | 1.58–1.85 | 1.69–1.94 |

TABLE-continued

| | Aga-crust | Convent. crust |
|---|---|---|
| Tensile strength in daN/cm$^2$ | 110–133 | 102–141 |
| Elongation in percent | 72–80 | 70–78 |

We claim:

1. A method of pre-treating and mineral-tanning hides or pelts which have been delimed and bated, characterized by agitating the pelts in a treatment vessel with a wash liquid containing 0.2–0.5 weight percent of acid based on the weight of the pelts; supplying carbon dioxide to said liquid during the treatment process in an amount corresponding to 0.5–5 percent of the weight of the pelts; draining the washing liquid from said pelts; optionally repeating the treatment with washing liquid at least once; and tanning said pelts with a mineral tanning substance after draining, or in case of repeated washing, final draining of washing liquid from the pelts.

2. A method according to claim 1, characterized by repeating the treatment with washing liquid from 1 to 3 times.

3. A method according to claim 1 or 2, characterized in that the washing liquid constitutes 50–200 percent of the weight of the pelts.

4. A method according to claim 3, characterized in that the washing liquid is water and that said acid is formic acid.

5. A method according to claim 4, characterized in that the washing time is 15–60 minutes.

6. A method according to claim 5, characterized by adding tanning salts to the pelts subsequent to the last washing-liquid draining step.

7. A method according to claim 6, characterized in that the tanning salts are in powder form.

8. A method according to claim 7, characterized in that the tanning salts are sulphate-masked salts having a basicity of 0–33%.

9. A method according to claim 8, characterized in that the tanning salts are added in a quantity of between 0.5–2 percent by weight, calculated on the weight of the pelts.

10. A method according to claim 9, characterized in that together with the tanning salts, treatment liquid comprising water is added in an amount corresponding to 0–30 percent by weight, calculated on the weight of the pelts.

11. A method according to claim 10, characterized by adding acid to the treatment liquid in an amount corresponding to 0.1–0.3 percent by weight, calculated on the weight of the pelts.

12. A method according to claim 11, characterized by adding to the treatment liquid carbon dioxide in an amount corresponding to 0.5 to 5 percent by weight of the weight of the pelts, in the form of a carbon-dioxide-containing gas or a carbon-dioxide-producing substance.

13. A method according to claim 12, characterized by rotating the treatment vessel subsequent to adding the tanning salts and while adding said carbon dioxide, and maintaining said rotation for a period of from 0.5 to 2 hours.

14. A method according to claim 13, characterized in that further tanning salts are added in an amount of 1–4 weight percent based on the weight of the pelts upon completion of said rotation time, whereafter the supply of carbon dioxide and rotation of the vessel is continued for 1–4 hours.

15. A method according to claim 14 characterized by interrupting the supply of carbon dioxide after 1–4 hours and adding water in an amount of 20–100 percent calculated on the weight of the pelts, under continued rotation of said vessel for at least 1 hour.

16. A method according to claim 1 wherein carbon dioxide is supplied to said liquid in the form of a gas by introducing gaseous carbon dioxide directly into said liquid or by delivering gaseous carbon dioxide over the surface of said liquid.

* * * * *